US011560789B2

(12) United States Patent
Zhang et al.

(10) Patent No.: US 11,560,789 B2
(45) Date of Patent: Jan. 24, 2023

(54) METHOD FOR PRE-WARNING DEFORMATION OF CASING PIPE ACCORDING TO CHANGE FEATURE OF B-VALUE OF HYDRAULIC FRACTURING INDUCED MICROSEISMICITY

(71) Applicant: Tongji University, Shanghai (CN)

(72) Inventors: Fengshou Zhang, Shanghai (CN); Rui Feng, Shanghai (CN); Zirui Yin, Shanghai (CN); Shutian Cao, Shanghai (CN); Luanxiao Zhao, Shanghai (CN)

(73) Assignee: Tongji University, Shanghai (CN)

( * ) Notice: Subject to any disclaimer, the term of this patent is extended or adjusted under 35 U.S.C. 154(b) by 0 days.

(21) Appl. No.: 17/504,806

(22) Filed: Oct. 19, 2021

(65) Prior Publication Data

US 2022/0243584 A1 Aug. 4, 2022

(30) Foreign Application Priority Data

Jan. 29, 2021 (CN) ..... 202110124011.0

(51) Int. Cl.
*E21B 47/107* (2012.01)
*E21B 47/14* (2006.01)

(52) U.S. Cl.
CPC ..... *E21B 47/107* (2020.05); *E21B 47/14* (2013.01)

(58) Field of Classification Search
CPC ..... E21B 47/14; E21B 47/107
See application file for complete search history.

(56) References Cited

U.S. PATENT DOCUMENTS 10,655,414 B1 * 5/2020 Wang ..... E21B 29/10
2016/0116621 A1 * 4/2016 Hoversten ..... G01V 1/52 367/35
2019/0302291 A1 * 10/2019 Lol ..... E21B 49/00
2020/0325751 A1 * 10/2020 Sharma ..... G01V 1/181

OTHER PUBLICATIONS

Chinese Doctoral Dissertations and Master's Theses Full-text Database (Doctor), Engineering Science and Technology, Sep. 17, 2021.

* cited by examiner

*Primary Examiner* — Christopher J Sebesta
(74) *Attorney, Agent, or Firm* — Bay State IP, LLC

(57) ABSTRACT

The present disclosure relates to a method for pre-warning deformation of a casing pipe according to a change feature of the b-value of the hydraulic fracturing induced microseismicity. Based on number distribution and seismic magnitudes of hydraulic fracturing induced microseismic monitoring events, a b-value of microseismicity in a fracturing stage is calculated according to a Gutenberg-Richter relation describing frequency-seismic magnitude distribution in seismology, and whether fault activation occurs in a fracturing process is identified according to a change feature of the b-value. According to the method, a cumulative effect of fault activation in the hydraulic fracturing process is considered, and symptoms of fault activation in the fracturing process can be accurately identified, so as to pre-warn deformation of the casing pipe.

1 Claim, 4 Drawing Sheets

METHOD FOR PRE-WARNING DEFORMATION OF CASING PIPE ACCORDING TO CHANGE FEATURE OF B-VALUE OF HYDRAULIC FRACTURING INDUCED MICROSEISMICITY

CROSS REFERENCE TO RELATED APPLICATION

This patent application claims the benefit and takes priority of the Chinese Patent Application No. 202110124011.0, filed on Jan. 29, 2021, the contents of which are herein incorporated by reference in its entirety as part of the present application.

TECHNICAL FIELD

The present disclosure relates to the technical field of shale gas exploitation.

BACKGROUND

With the continuous exploitation of Changning-Weiyuan shale gas block in Sichuan province in China, the casing pipe deforms more frequently during hydraulic fracturing. Due to the deformation of the casing pipe, the bridge plug may not be set in place, the number of fracturing intervals is reduced and the yield of a single well is reduced. In addition, the integrity of a well is poor, so the life cycle of the well is shortened, and therefore the overall economic benefit of shale gas development is affected. By analyzing and processing the deformation information of the casing pipe collected on-site, researchers find that deformation of the shale gas casing pipe is mainly resulted from activation and dislocation of some small faults in the hydraulic fracturing process. On-site technicians hope to capture fault activation information in advance by means of microseismic monitoring to pre-warn the deformation of the casing pipe, so as to guide constructors to more reasonably exploit the shale gas, and further to reduce the probability of the deformation of the casing pipe.

In practice, the on-site technicians can pre-warn the deformation of the casing pipe by means of technical measures, for example, microseismic magnitude analysis, observation of microseismic distribution pattern, etc.

At present, pre-warning of the deformation of the casing pipe is merely dependent on the artificial observation of microseismic data in the prior art. This way at least has the following problems:

Since microseismic monitoring has uncertainty, whether a fault is activated in the fracturing process cannot be sufficiently determined only by manually observing a large-magnitude signal, it lacks a reliable discrimination standard to identify the fault activation by observing the form of the microseismicity, and errors caused by subjective factors exist.

Prior Knowledge:

The b-value refers to the slope of a frequency-magnitude distribution relation of a seismic event in a certain area in the seismic field. The b-value is commonly used in seismology to represent the failure mode of the seismic event, for example, a higher b-value means a relatively larger proportion of small magnitude earthquakes, while a lower b-value means large magnitude events happen relatively more often.

In the seismic field, the b-value is usually calculated for a certain area only.

SUMMARY

The present disclosure provides a method for pre-warning deformation of a casing pipe according to a change feature of a b-value of a hydraulic fracturing induced microseismicity, so as to overcome the defect that fault activation information may not be accurately captured in the prior art.

The objective of the present disclosure is achieved by the following technical solutions:

In a method for pre-warning deformation of a casing pipe according to a change feature of a b-value of a hydraulic fracturing induced microseismicity, fracturing construction of a horizontal well interval of a shale gas well in an oil and gas exploitation field is separately performed at a plurality of sub-well intervals (fracturing intervals), b-values are calculated separately with the plurality of fracturing intervals as different areas, so as to obtain a continuous change feature of the b-values along with the horizontal well interval, and fault activation information is identified according to the continuous change feature of the b-values, so as to determine and pre-warn the deformation of the casing pipe.

Specifically, the method may include:

S1, dividing the horizontal well interval into the plurality of fracturing intervals according to fracturing intervals of an object well;

S2, determining parameters, including the number N of microseismic events, the magnitude M of microseismic events, etc., required for calculating a b-value of the microseismicity in a fracturing stage;

S3, calculating the b-value of the microseismicity in the fracturing stage according to a Gutenberg-Richter relation in seismology;

S4, repeating S2 and S3 according to the number of intervals on the basis of the fracturing intervals determined in S1, sequentially calculating b-values of other subsequent fracturing intervals, and drawing a b-value change feature curve of all fracturing intervals;

S5, finding out, on the b-value curve of the fracturing intervals drawn in S4, an inflection point at which the b-value has an obvious decreasing feature, where the fracturing interval corresponding to the inflection point possibly activates a fault and causes deformation of the casing pipe; and S6, sending, according to fault activation information in a fracturing process determined in S5, a pre-warning signal to subsequent fracturing construction, and taking corresponding measures to prevent possible deformation of the casing pipe.

DETAILED DESCRIPTION

Fracturing construction of a horizontal well interval of a shale gas well in an oil and gas exploitation field is separately performed at a plurality of sub-well intervals (fracturing intervals), then b-values are calculated separately with the plurality of fracturing intervals as different areas, so as to obtain a continuous change feature of the b-values along with the horizontal well interval, and fault activation information is identified according to the continuous change feature of the b-values, so as to determine and pre-warn the deformation of the casing pipe.

The present disclosure is further described below in conjunction with the accompanying drawings, and the scope of protection of the present disclosure is not limited to the following description.

The method includes:

S1, the horizontal well interval is divided into the plurality of fracturing intervals according to fracturing intervals of an object well.

As an embodiment, according to the fracturing interval of an object well, a certain well with typical casing pipe deformation in a Changning block is selected as an example for analysis, the well is transformed in a staged fracturing mode, and a horizontal well interval is divided into thirty fracturing intervals in total.

S2, basic parameters including the number N of microseismic signals and the magnitude M of each fracturing interval for calculating the b-value of the microseismicity are determined.

Figure 1:
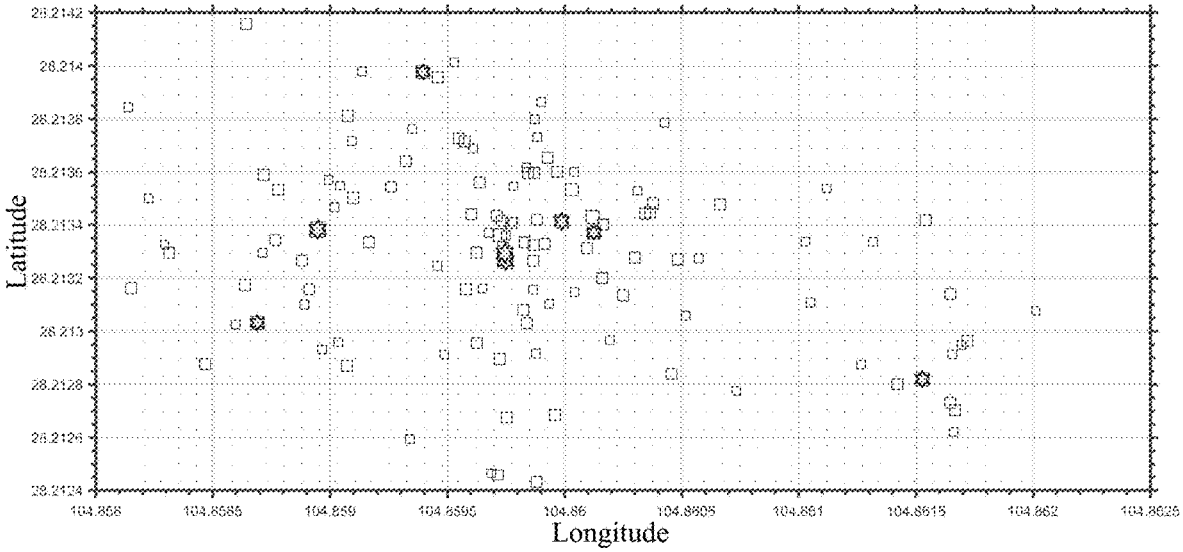
FIG. 1 is a schematic diagram of the number and magnitude distribution of microseismic events in a first fracturing stage of an exemplary well.

Microseismic data of the first fracturing interval of the example well are shown in FIG. 1. A rectangular square represents a microseismic signal generated by the first fracturing interval of the example well, and a star symbol represents a microseismic signal with a larger magnitude.

S3, the b-value of the microseismicity of the first fracturing interval is calculated, where a calculation formula of the b-value is a Gutenberg-Richter relation (in the prior art) for describing frequency-magnitude distribution in seismology:

$$\log_{10} N(m \geq M) = a - b * M \quad (1)$$

where N (m≥M) represents the number of seismic events of which the magnitude m is greater than or equal to the magnitude M;

a represents the activity of the seismicity in the area, and when M=0, the number of all seismic events in the area is represented, that is, $\mathbf{10}^{a}$; and b is an absolute value of a slope of a linear part of the frequency-magnitude distribution.

Figure 2:
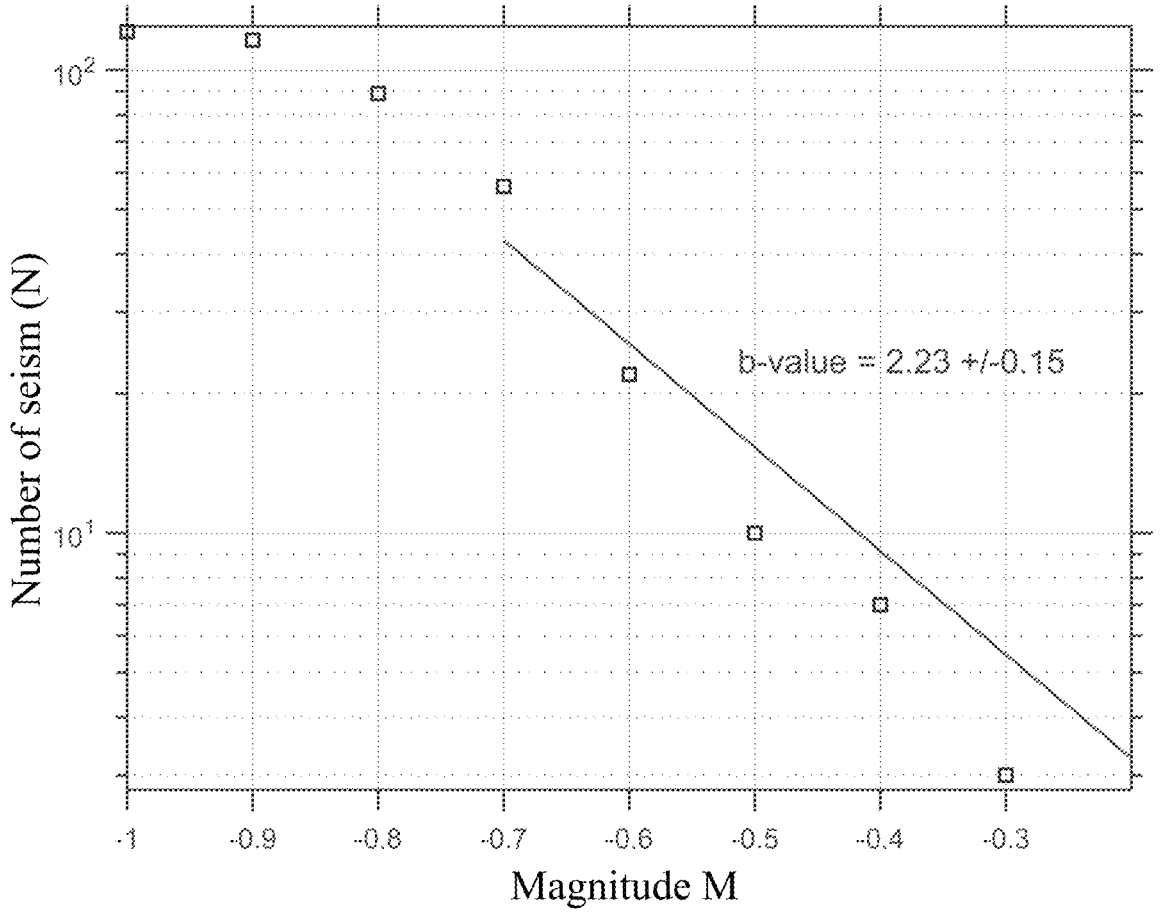
FIG. 2 is a schematic diagram of the calculation of a b-value of the microseismicity in the first fracturing stage of the exemplary well.
Figure 3:
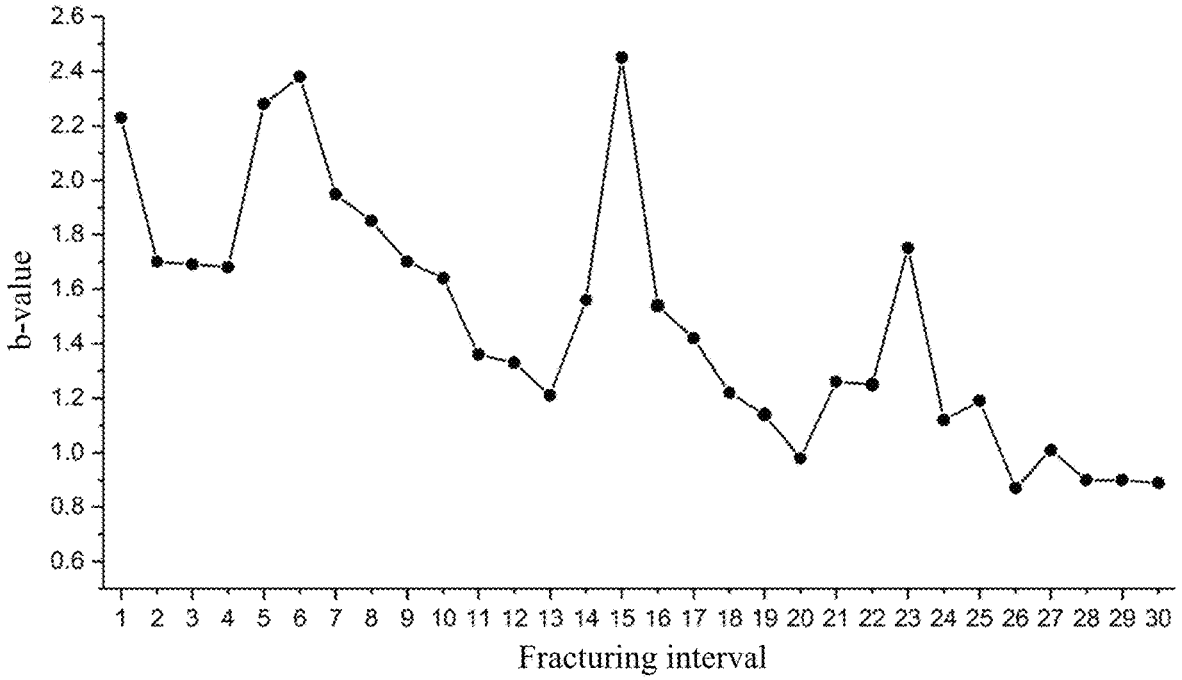
FIG. 3 is a schematic diagram of a b-value change feature curve of the exemplary well.

In a frequency-magnitude diagram shown in FIG. 2, N corresponds to the number of microseismic events of the first fracturing interval determined in S2, m corresponds to the magnitude of the microseismic events of the first fracturing interval determined in S2, and M refers to an axis X in the frequency-magnitude diagram. A maximum curvature solution may be used for solving that the b-value of the microseismicity of the first fracturing interval is about 2.23, as shown in FIG. 2.

Figure 4:
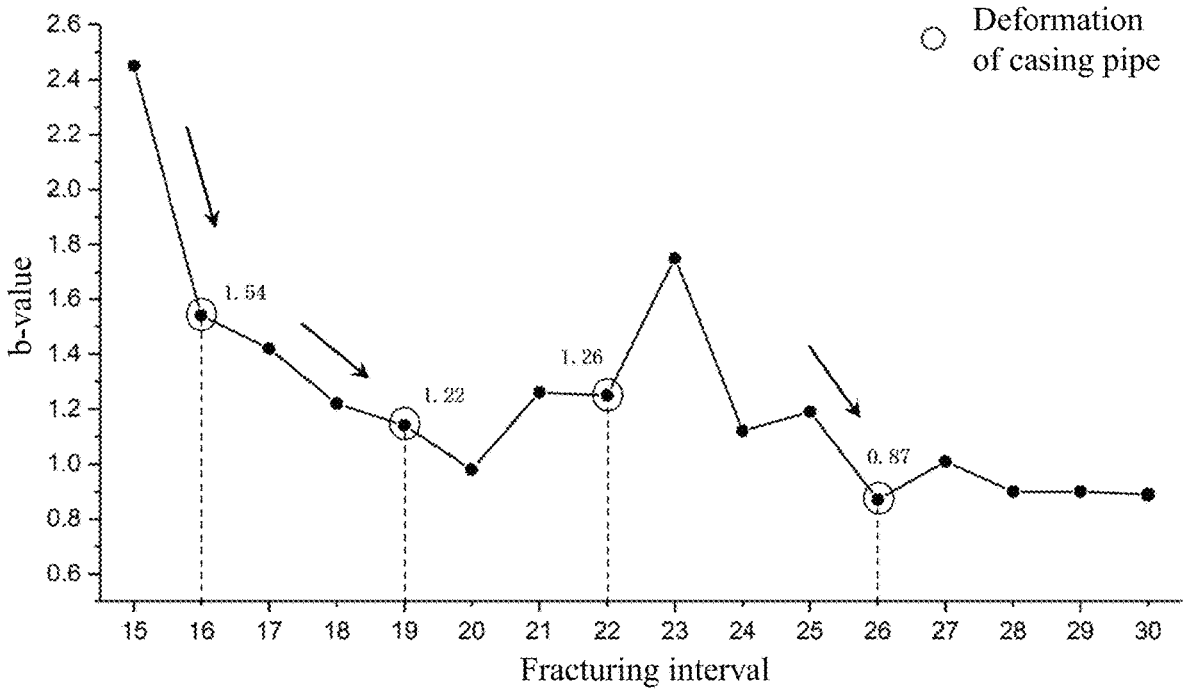
FIG. 4 is a schematic diagram of identifying fault activation according to a change feature of the b-value.
Figure 5:
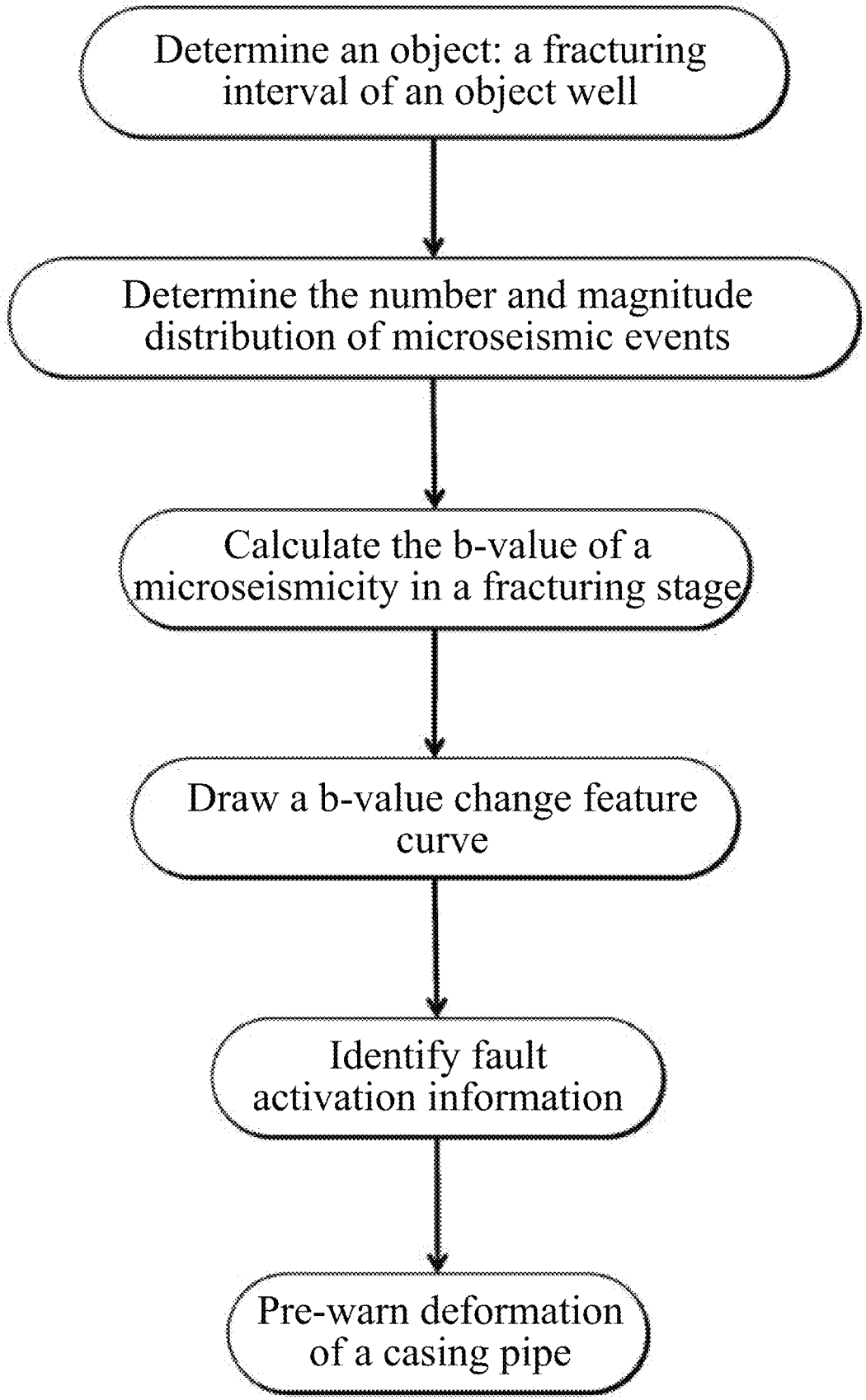
FIG. 5 is a flow diagram of the present disclosure.

S4, S2 and S3 are repeated according to the number of intervals on the basis of the fracturing intervals determined in S1, b-values of other subsequent fracturing intervals are sequentially calculated, and a b-value change feature curve of all fracturing intervals of the exemplary well is drawn in FIG. 4.

S5, on the b-value curve of the fracturing intervals drawn in S4, an inflection point at which the b-value has an obvious decreasing feature is found out, where the fracturing interval corresponding to the inflection point possibly activates a fault and causes deformation of the casing pipe.

In the embodiment, the deformation of the casing pipe of the example well is mainly concentrated in the rear half interval of the horizontal interval, so the fracturing intervals 15-30 of the well are selected to show how to identify the fault activation information according to the change features of the b-values. The fracturing interval corresponding to the circled inflection point in FIG. 4 is a fracturing interval where deformation of the casing pipe is actually detected, and fracturing of this interval activates the fault and thus causes deformation of the casing pipe. The change features of the b-values of the fracturing intervals with deformation of the casing pipe may be observed to find that the b-values all have an obvious downward feature from the aspect of overall distribution, which is consistent with the fault activation b-value identification feature provided by the present disclosure, and also accords with a feature of a b-value on a fault activation zone in the natural seismicity. Therefore, the fault activation information in the fracturing process may be well captured according to the change feature of the b-value.

S6, according to fault activation information in a fracturing process determined in S5, a pre-warning signal is sent to subsequent fracturing construction, and corresponding measures are taken to prevent possible deformation of the casing pipe.

When a b-value of a certain fracturing interval has an obvious downward trend (in the embodiment, a difference value greater than 0.5 is a determination value) compared with that of a front fracturing interval, and the value is close to 1 from the aspect of the overall distribution, it may be indicated that fracturing of this interval tends to activate a fault. At this time, the pre-warning signal is sent to the subsequent fracturing construction, and the corresponding measures are taken to prevent possible deformation of the casing pipe.

The present disclosure innovatively puts forward that the b-value calculated on the basis of the microseismic data is used for pre-warning the deformation of the casing pipe, and compared with the prior art, the fault activation information may be captured more accurately, and the deformation of the casing pipe is more reasonably pre-warned. According to the definition of the b-value, it may be seen that generally the larger b-value represents that an occupation ratio of the small-magnitude events is higher, and conversely, the smaller b-value represents that an occurrence frequency of the large-magnitude event is higher, so the b-value reflects the occupation ratio of the large-magnitude event and the small-magnitude event in the microseismic information, and compared with fault activation identification only through the occurrence of the large-magnitude events, the present disclosure contains more information sufficiently, such that the credibility of representing fault activation is relatively higher. In general, a fault activation process is a cumulative effect caused by multi-stage fracturing, and a certain amount of microseismic data is required for calculating the b-value, so in the calculation process, a b-value of a certain stage may be calculated by taking all microseismic events of the stage and two stages before the stage, which further expands richness of the data, and fully considers the cumulative effect of fault activation.

In the present disclosure, fault activation information is captured in advance by identifying the change feature of the b-value in microseismic monitoring to pre-warn the deformation of the casing pipe, so as to guide constructors to more reasonably exploit the shale gas, and further to reduce the probability of the deformation of the casing pipe.

What is claimed is:

1. A method for pre-warning deformation of a casing pipe according to a change feature of a b-value of a hydraulic fracturing induced microseismicity, wherein fracturing construction of a horizontal well interval of a shale gas well in an oil and gas exploitation field is separately performed at a plurality of fracturing intervals which are obtained by dividing the horizontal well interval, b-values are calculated separately with the plurality of fracturing intervals as different areas, so as to obtain a continuous change feature of the b-values along with the horizontal well interval, and fault activation information is identified according to the continuous change feature of the b-values, so as to determine and pre-warn the deformation of the casing pipe; and specifically, the method for pre-warning deformation of a casing pipe according to a change feature of a b-value of a hydraulic fracturing induced microseismicity comprises the following steps:

S1, dividing the horizontal well interval into the plurality of fracturing intervals according to fracturing intervals of an object well;

S2, determining parameters, comprising the number N of the microseismic events and the magnitude M of the microseismic events, required for calculating the b-value of the microseismicity in a fracturing stage;

S3, calculating the b-value of the microseismicity in the fracturing stage according to a Gutenberg-Richter relation in seismology;

S4, repeating S2 and S3 according to the number of intervals on the basis of the fracturing intervals determined in S1, sequentially calculating b-values of other subsequent fracturing intervals, and drawing a b-value change feature curve of all fracturing intervals;

S5, finding out, on the b-value curve of the fracturing intervals drawn in S4, an inflection point at which the b-value has an obvious decreasing feature and is close to 1, wherein the fracturing interval corresponding to the inflection point possibly activates a fault and causes deformation of the casing pipe;

S6, sending, according to fault activation information in a fracturing process determined in S5, a pre-warning signal to subsequent fracturing construction, and taking corresponding measures to prevent possible deformation of the casing pipe.

* * * * *